US008878854B2

(12) United States Patent
Bias et al.

(10) Patent No.: US 8,878,854 B2
(45) Date of Patent: Nov. 4, 2014

(54) HEATING, VENTILATION AND AIR CONDITIONING SYSTEM USER INTERFACE HAVING ADJUSTABLE FONTS AND METHOD OF OPERATION THEREOF

(75) Inventors: Larry S. Bias, Prosper, TX (US); Daniel Castillo, Plano, TX (US); Bobby DiFulgentiz, Frisco, TX (US); Gabaza B. Mlambo, McKinney, TX (US); Stephen J. Vendt, Little Elm, TX (US)

(73) Assignee: Lennox Industries Inc., Richardson, TX (US)

( * ) Notice: Subject to any disclaimer, the term of this patent is extended or adjusted under 35 U.S.C. 154(b) by 118 days.

(21) Appl. No.: 13/432,929

(22) Filed: Mar. 28, 2012

(65) Prior Publication Data

US 2013/0147829 A1 Jun. 13, 2013

Related U.S. Application Data

(60) Provisional application No. 61/569,859, filed on Dec. 13, 2011.

(51) Int. Cl.

| | |
|---|---|
| ***G09G 5/02*** | (2006.01) |
| ***G06F 3/045*** | (2006.01) |
| ***G09G 5/00*** | (2006.01) |
| ***G06T 11/00*** | (2006.01) |

(52) U.S. Cl.

USPC ..... 345/471; 345/589; 345/581

(58) Field of Classification Search

None

See application file for complete search history.

(56) References Cited

U.S. PATENT DOCUMENTS

| | | | | |
|---|---|---|---|---|
| 5,867,399 | A * | 2/1999 | Rostoker et al. | 716/102 |
| 6,496,182 | B1 * | 12/2002 | Wong et al. | 345/173 |
| 7,114,554 | B2 * | 10/2006 | Bergman et al. | 165/238 |
| 7,152,806 | B1 * | 12/2006 | Rosen | 236/94 |
| 7,222,494 | B2 * | 5/2007 | Peterson et al. | 62/178 |
| 7,232,075 | B1 * | 6/2007 | Rosen | 236/51 |
| 7,287,709 | B2 * | 10/2007 | Proffitt et al. | 236/94 |
| 7,352,339 | B2 * | 4/2008 | Morgan et al. | 345/31 |
| 7,454,269 | B1 * | 11/2008 | Dushane et al. | 700/276 |
| 7,455,240 | B2 * | 11/2008 | Chapman et al. | 236/91 D |
| 7,636,604 | B2 * | 12/2009 | Bergman et al. | 700/17 |
| 8,244,383 | B2 * | 8/2012 | Bergman et al. | 700/17 |

(Continued)

FOREIGN PATENT DOCUMENTS

| | | | |
|---|---|---|---|
| EP | 1811241 | A2 | 7/2007 |
| EP | 2045541 | A1 | 8/2009 |
| WO | 2007091776 | A2 | 8/2007 |

OTHER PUBLICATIONS

Extron Electronics, The Extron Guide to Graphical User Interface Design, 2010.*

(Continued)

*Primary Examiner* — Said Broome
*Assistant Examiner* — Charles L Beard

(57) ABSTRACT

A user interface for use with an HVAC system, a method of providing service reminders on a single screen of a user interface of an HVAC system and an HVAC system incorporating the user interface or the method. The user interface includes a display configured to provide information to a user, a touchpad configured to accept input from the user, and a processor and memory coupled to the display and the touchpad and configured to drive the display, wherein the display further configured to provide a button that allows a user to adjust an attribute of text displayed on the display.

21 Claims, 3 Drawing Sheets

(56) References Cited

U.S. PATENT DOCUMENTS

| | | | | |
|---|---|---|---|---|
| 8,346,397 | B2 * | 1/2013 | Harrod et al. | 700/276 |
| 8,387,892 | B2 * | 3/2013 | Koster et al. | 236/94 |
| 8,442,693 | B2 * | 5/2013 | Mirza et al. | 700/276 |
| 8,452,456 | B2 * | 5/2013 | Devineni et al. | 700/276 |
| 8,463,442 | B2 * | 6/2013 | Curry et al. | 700/276 |
| 8,463,443 | B2 * | 6/2013 | Grohman et al. | 700/276 |
| 8,493,008 | B2 * | 7/2013 | Merkel et al. | 318/400.08 |
| 8,498,753 | B2 * | 7/2013 | Steinberg et al. | 700/300 |
| 8,527,096 | B2 * | 9/2013 | Pavlak et al. | 700/276 |
| 8,595,613 | B1 * | 11/2013 | Mills et al. | 715/234 |
| 2002/0049847 | A1 * | 4/2002 | McArdle et al. | 709/227 |
| 2002/0081037 | A1 * | 6/2002 | Higgs et al. | 382/245 |
| 2003/0067488 | A1 * | 4/2003 | Rudd et al. | 345/765 |
| 2005/0040250 | A1 * | 2/2005 | Wruck | 236/51 |
| 2005/0119766 | A1 * | 6/2005 | Amundson et al. | 700/17 |
| 2006/0211494 | A1 * | 9/2006 | Helfer | 463/30 |
| 2007/0029397 | A1 * | 2/2007 | Mueller et al. | 236/46 C |
| 2007/0043607 | A1 * | 2/2007 | Howard et al. | 705/10 |
| 2007/0171223 | A1 * | 7/2007 | McArdle et al. | 345/420 |
| 2007/0188427 | A1 * | 8/2007 | Lys et al. | 345/82 |
| 2007/0266329 | A1 * | 11/2007 | Gaudette | 715/763 |
| 2008/0079750 | A1 * | 4/2008 | Setlur | 345/593 |
| 2008/0211779 | A1 * | 9/2008 | Pryor | 345/173 |
| 2008/0215240 | A1 * | 9/2008 | Howard et al. | 701/213 |
| 2008/0307342 | A1 * | 12/2008 | Furches et al. | 715/764 |
| 2009/0009534 | A1 * | 1/2009 | Perani et al. | 345/665 |
| 2009/0057425 | A1 * | 3/2009 | Sullivan et al. | 236/51 |
| 2009/0064039 | A1 * | 3/2009 | Lee et al. | 715/810 |
| 2009/0140056 | A1 | 6/2009 | Leen | |
| 2009/0140064 | A1 * | 6/2009 | Schultz et al. | 236/51 |
| 2009/0164925 | A1 * | 6/2009 | Grundelius | 715/764 |
| 2009/0167509 | A1 * | 7/2009 | Fadell et al. | 340/407.2 |
| 2009/0198505 | A1 * | 8/2009 | Gipps et al. | 705/1 |
| 2010/0070085 | A1 * | 3/2010 | Harrod et al. | 700/276 |
| 2010/0070089 | A1 * | 3/2010 | Harrod et al. | 700/277 |
| 2010/0070907 | A1 * | 3/2010 | Harrod et al. | 715/772 |
| 2010/0107076 | A1 * | 4/2010 | Grohman et al. | 715/709 |
| 2010/0107112 | A1 * | 4/2010 | Jennings et al. | 715/777 |
| 2010/0179696 | A1 * | 7/2010 | Grohman et al. | 700/276 |
| 2010/0182137 | A1 * | 7/2010 | Pryor | 340/425.5 |
| 2010/0207951 | A1 * | 8/2010 | Plaisted et al. | 345/473 |
| 2010/0280956 | A1 * | 11/2010 | Chutorash et al. | 705/64 |
| 2011/0074687 | A1 * | 3/2011 | Takaoka et al. | 345/168 |
| 2011/0082627 | A1 * | 4/2011 | Small et al. | 701/48 |
| 2011/0157357 | A1 * | 6/2011 | Weisensale et al. | 348/143 |
| 2011/0212717 | A1 * | 9/2011 | Rhoads et al. | 455/420 |
| 2011/0246440 | A1 * | 10/2011 | Kocks et al. | 707/706 |
| 2011/0246891 | A1 * | 10/2011 | Schubert et al. | 715/719 |
| 2011/0248822 | A1 * | 10/2011 | Sarihan | 340/5.81 |
| 2011/0257973 | A1 * | 10/2011 | Chutorash et al. | 704/235 |
| 2011/0288854 | A1 * | 11/2011 | Glass et al. | 704/9 |
| 2012/0001934 | A1 * | 1/2012 | Bala et al. | 345/594 |
| 2012/0012662 | A1 * | 1/2012 | Leen et al. | 236/51 |
| 2012/0039503 | A1 * | 2/2012 | Chen et al. | 382/100 |
| 2012/0046947 | A1 * | 2/2012 | Fleizach | 704/260 |
| 2012/0120092 | A1 * | 5/2012 | Mukai et al. | 345/589 |
| 2012/0176405 | A1 * | 7/2012 | Katsukura et al. | 345/619 |
| 2012/0181010 | A1 * | 7/2012 | Schultz et al. | 165/288 |
| 2012/0192076 | A1 * | 7/2012 | Rocca | 715/738 |
| 2012/0310418 | A1 * | 12/2012 | Harrod et al. | 700/276 |
| 2013/0151017 | A1 * | 6/2013 | Bias et al. | 700/276 |

OTHER PUBLICATIONS

Apple Inc, Dashcode User Guide, 2009.*

EP Search Report dated May 6, 2013, Application No. 12197028.9-1602, Applicant: Lennox Industries Inc., 5 pages.

* cited by examiner

HEATING, VENTILATION AND AIR CONDITIONING SYSTEM USER INTERFACE HAVING ADJUSTABLE FONTS AND METHOD OF OPERATION THEREOF

CROSS-REFERENCE TO RELATED APPLICATION

This application claims the benefit of U.S. Provisional Application Ser. No. 61/569,859, filed by Bias, et al., on Dec. 13, 2011, entitled "Heating, Ventilation and Air Conditioning System User Interface Having One or More of One-Touch Away Feature, Adjustable Fonts, Proportional Animation Graphics, Service Reminders on a Single Screen, Separate Programming and Manual Mode Screens, Integrated Screen/Housing Skin, Low-Profile Housing, Secure Functional Upgrade Feature and Remote Platform Access Application Associated Therewith," commonly assigned with this application and incorporated herein by reference.

TECHNICAL FIELD

This application is directed, in general, to a heating, ventilation and air conditioning (HVAC) systems and, more specifically, to an HVAC system having a user interface, such as a thermostat.

BACKGROUND

Users interact with HVAC systems through user interfaces. The most common user interface employed today is the thermostat. The most basic thermostats feature one or more dials, switches or levers and allow users to set temperatures. More elaborate thermostats feature a liquid crystal display (LCD) screen, perhaps even of the touchscreen variety, and allow users to program their HVAC systems for automatic temperature settings, configure and maintain their HVAC systems and records of historical operation data, allowing the users to gauge the performance and efficiency of their HVAC systems.

Thermostats necessarily include both temperature sensors and control circuitry within their housings. Some user interfaces do not qualify as thermostats, because while they communicate with temperature sensors and control circuitry, they do not include both within their housings.

SUMMARY

One aspect provides a user interface. In one embodiment, the user interface includes: (1) a display configured to provide information to a user, (2) a touchpad configured to accept input from the user and (3) a processor and memory coupled to the display and the touchpad and configured to drive the display, the display further configured to provide a button that allows a user to adjust an attribute of text displayed on the display.

Another aspect provides a method of configuring a display on a user interface of an HVAC system. In one embodiment, the method includes: (1) providing information to a user with a display, (2) accepting input from the user with a touchpad and (3) allowing a user to adjust an attribute of text displayed on the display.

Yet another aspect provides an HVAC system. In one embodiment, the HVAC system includes: (1) a heat pump or a compressor having at least one stage, (2) at least one condenser coil, (3) an expansion valve, (4) at least one evaporator coil, (5) a loop of pipe interconnecting the heat pump or compressor, the at least one condenser coil, the expansion valve and the at least one evaporator coil and containing a refrigerant, (6) at least one fan configured to cause outdoor air and indoor air to blow over the at least one condenser coil and the least one evaporator coil and (7) a user interface, including: (7a) a display configured to provide information to a user, (7b) a touchpad configured to accept input from the user and (7c) a processor and memory coupled to the display and the touchpad and configured to drive the display, the display further configured to provide a button that allows a user to adjust an attribute of text displayed on the display.

BRIEF DESCRIPTION

Reference is now made to the following descriptions taken in conjunction with the accompanying drawings, in which.

DETAILED DESCRIPTION

Figure 1:
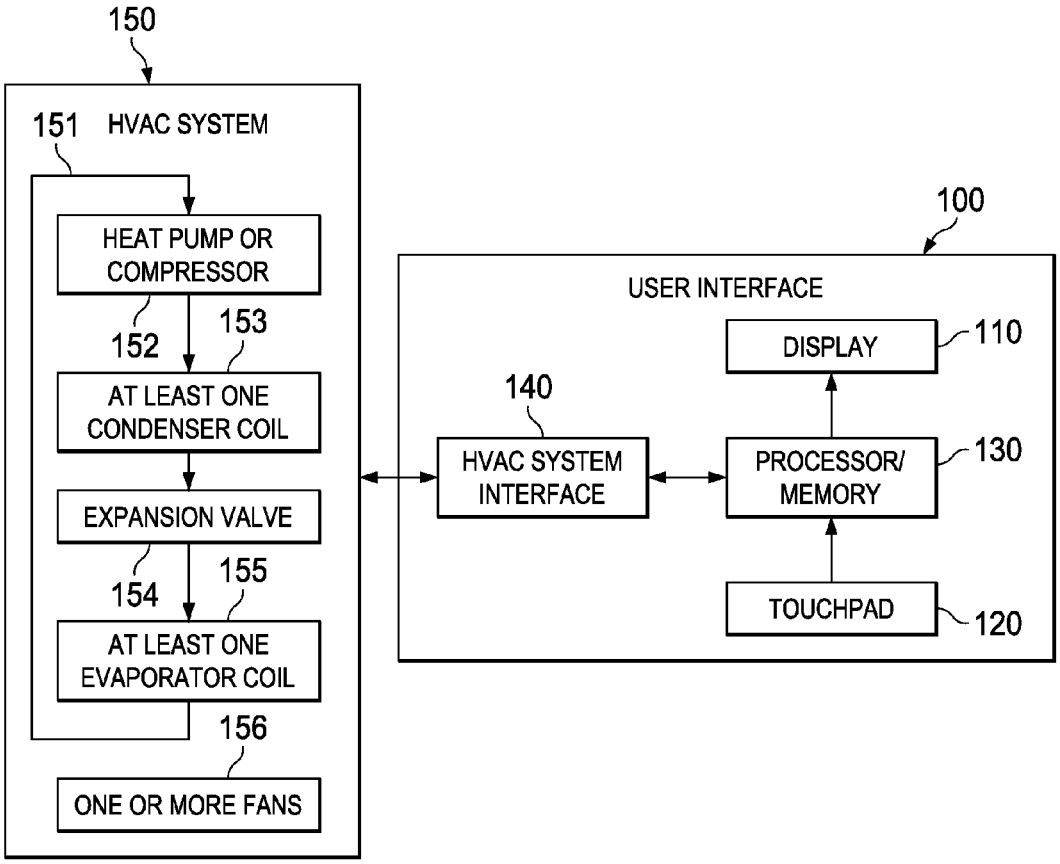
FIG. 1 is a block diagram of one embodiment of a user interface.

FIG. 1 is a block diagram of one embodiment of a user interface 100. The interface has a display 110 and a touchpad 120. The display 110 is configured to provide information to a user, and the touchpad 120 is configured to accept input from a user. A processor and memory 130 are coupled to the display 110 and the touchpad 120 to drive the display 110 and process the input from the touchpad 120. More accurately, software or firmware is loaded into and stored in the memory and, when executed in the processor, configures the processor to drive the display 110 and process the input from the touchpad 120. An HVAC system interface 140 is coupled to the processor and memory 130 and is configured to provide communication between the processor and memory 130 and the remainder of an HVAC system 150. In various embodiments, the HVAC system 150 includes one or more loops of pipe (one being shown and referenced as 151) containing a refrigerant. Each loop transports the refrigerant among a heat pump or a compressor 152 having at least one stage, at least one condenser coil 153, an expansion valve 154 and at least one evaporator coil 155. One or more fans ("blowers") 156 cause outdoor air and indoor air to blow over the at least one condenser coil 153 and the at least one evaporator coil 155 to transfer heat to or from them. Those skilled in the pertinent art are familiar with conventional HVAC systems and generally understand the many embodiments and forms they may take.

Figure 2:
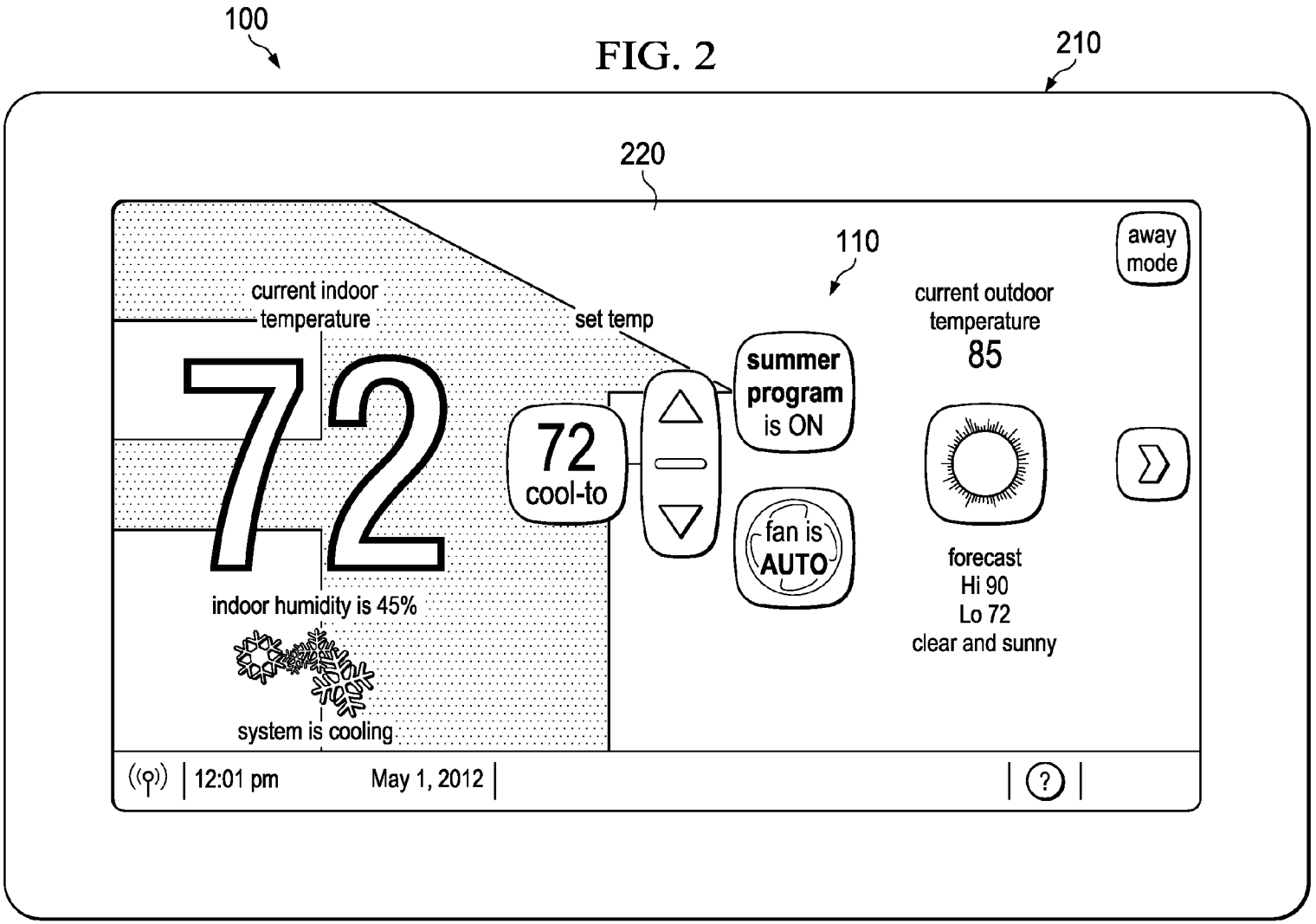
FIG. 2 is a front-side elevational view of one embodiment of a user interface.

FIG. 2 is a front-side elevational view of one embodiment of the user interface of FIG. 1. The user interface 100 has a bezel 210. The display 110 is configured to display at least one screen 220 of information for the benefit of a user (the term also including an installer or any other person interested in gaining information from the user interface 100).

Although unreferenced, the screen 220 shown in FIG. 2 includes a current temperature display portion, a setpoint temperature display portion, buttons to raise or lower the setpoint temperature, a system mode message display portion (i.e., "system is heating") and a program status message display portion (i.e., "program is on"). The screen 220 also has current date and time display portions and allows the user to display other screens (via a "press for more" message).

Figure 3:
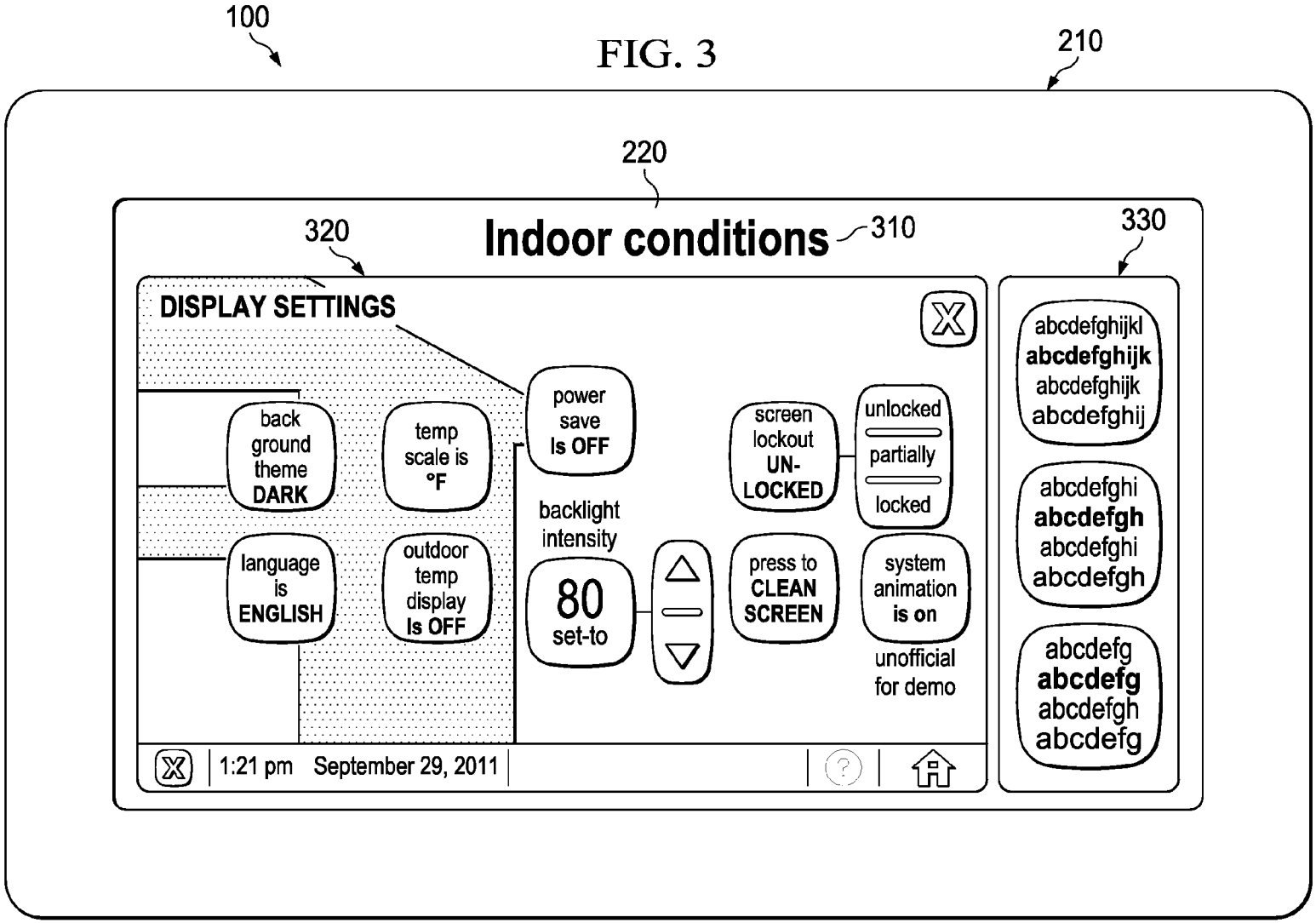
FIG. 3 is a representation of one embodiment of a screen of the user interface of FIG. 2 having one embodiment of adjustable fonts.

FIG. 3 is a representation of one embodiment of a screen of the user interface of FIG. 2 having one embodiment of adjustable fonts. According to the illustrated embodiment, a screen of the user interface can provide one or more buttons 310 that allow a user to adjust the size or other attributes (e.g., emphasis, color or effects) of any text that is displayed on the user interface (e.g., those shown in a screen 320). In general, giving the user the ability to adjust the font size provides an easy way for a user to improve the readability of text and information displayed on his user interface. This capability will become increasingly relevant for users as the number of features included in high-end communicating user interfaces increases. This feature should also facilitate the proper use of user interfaces by users with diminished visual capacity (e.g., nearsightedness, color blindness or other eye conditions).

In certain embodiments, users would have the ability to adjust font for size and color, subject to a minimum and maximum allowed size (e.g., from 8 point to 18 point type for Arial narrow font) as shown in screen buttons 330. In related embodiments, users access the settings through a display settings screen.

In certain embodiments, instead of explicitly selecting a font color or size, users could select among the following modes optimized for a particular circumstance or visual impairment:

"Optimized for color blindness;" black and white colors, avoid red-green, which is the most predominant form of color blindness.

"Optimized for distance;" largest available font size.

"Minimize glare;" LCD brightness, font color and size are adjusted for viewing under glare.

"Nighttime viewing;" font color and size are adjusted for viewing in low lighting conditions. Display brightness may also be adjusted.

Figure 4:
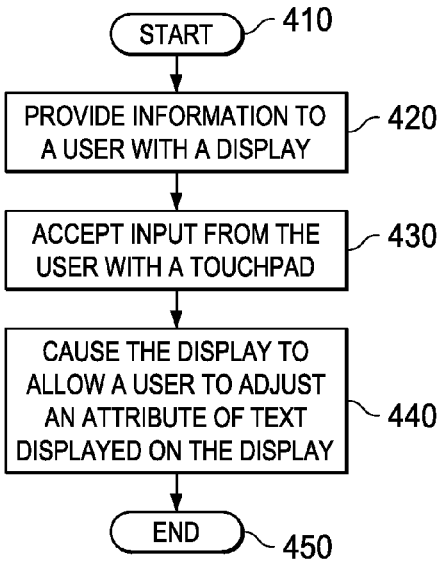
FIG. 4 is a flow diagram of one embodiment of a method of configuring a display on a user interface of an HVAC system.

FIG. 4 is a flow diagram of one embodiment of a method of configuring a display on a user interface of an HVAC system. The method begins in a start step 410. In a step 420, information is provided to a user with a display. In a step 430, input from the user is accepted with a touchpad. In a step 440, the display is caused to allow a user to adjust an attribute of text displayed on the display. The method ends in an end step 450.

Those skilled in the art to which this application relates will appreciate that other and further additions, deletions, substitutions and modifications may be made to the described embodiments.

What is claimed is:

1. A user interface for use with an HVAC system, comprising:

a display configured to provide information to a user; and a processor and memory coupled to said display and configured to drive said display, said display further configured to provide two or more buttons on one screen of said display that allow said user of said HVAC system to adjust an attribute of any text displayed on said display, wherein each of the two or more buttons provides a preview and selection of adjustment options.

2. The user interface as recited in claim 1 wherein said attribute is selected from the group consisting of:

text emphasis, text color, and text effects.

3. The user interface as recited in claim 1 wherein said attribute is text size and said button allows said user to adjust said text size subject to a minimum and maximum allowed size.

4. The user interface as recited in claim 1 wherein said button allows said user to select a mode that is optimized for color-blindness.

5. The user interface as recited in claim 1 wherein said button allows said user to select a mode that is optimized for distance.

6. The user interface as recited in claim 1 wherein said button allows said user to select a mode that is optimized to minimize glare.

7. The user interface as recited in claim 1 wherein said button allows said user to select a mode that is optimized for nighttime viewing.

8. A method of configuring a display on a user interface of an HVAC system, comprising:

providing information to a user with a display;

accepting input from said user; and allowing said user of said HVAC system to adjust, via two or more buttons on one screen of said display, an attribute of any text displayed on said display, wherein each of the two or more buttons provides a preview and selection of adjustment options.

9. The method as recited in claim 8 wherein said attribute is selected from the group consisting of:

text emphasis, text color, and text effects.

10. The method as recited in claim 8 wherein said attribute is text size and said button allows said user to adjust said text size subject to a minimum and maximum allowed size.

11. The method as recited in claim 8 wherein said button allows said user to select a mode that is optimized for color-blindness.

12. The method as recited in claim 8 wherein said button allows said user to select a mode that is optimized for distance.

13. The method as recited in claim 8 wherein said button allows said user to select a mode that is optimized to minimize glare.

14. The method as recited in claim 8 wherein said button allows said user to select a mode that is optimized for nighttime viewing.

15. An HVAC system, comprising:

a heat pump or a compressor having at least one stage;

at least one condenser coil;

an expansion valve;

at least one evaporator coil;

a loop of pipe interconnecting said heat pump or compressor, said at least one condenser coil, said expansion valve and said at least one evaporator coil and containing a refrigerant;

at least one fan configured to cause outdoor air and indoor air to blow over said at least one condenser coil and said least one evaporator coil; and a user interface, including:

a display configured to provide information to a user, a touchpad configured to accept input from said user, and a processor and memory coupled to said display and said touchpad and configured to drive said display, said display further configured to provide two or more buttons on one screen of said display that allow said user of said HVAC system to adjust an attribute of any text displayed on said display, wherein each of the two or more buttons provides a preview and selection of adjustment options.

16. The HVAC system as recited in claim 15 wherein said attribute is selected from the group consisting of:

text emphasis, text color, and text effects.

17. The HVAC system as recited in claim 15 wherein said attribute is text size and said button allows said user to adjust said text size subject to a minimum and maximum allowed size.

18. The HVAC system as recited in claim 15 wherein said button allows said user to select a mode that is optimized for color-blindness.

19. The HVAC system as recited in claim 15 wherein said button allows said user to select a mode that is optimized for distance.

20. The HVAC system as recited in claim 15 wherein said button allows said user to select a mode that is optimized to minimize glare.

21. The HVAC system as recited in claim 15 wherein said button allows said user to select a mode that is optimized for nighttime viewing.

* * * * *